United States Patent [19]

Antonious

[11] 4,215,493

[45] Aug. 5, 1980

[54] ADJUSTABLE INSTEP GORE ASSEMBLY

[76] Inventor: Anthony J. Antonious, 205 E. Joppa Rd., Towson, Md. 21204

[21] Appl. No.: 890,487

[22] Filed: Mar. 27, 1978

[51] Int. Cl.[2] ..... A43B 11/00

[52] U.S. Cl. ..... 36/51

[58] Field of Search ..... 24/204, 73 GC; 36/50, 36/51, 54, 128, 129; 2/DIG. 6

[56] References Cited

U.S. PATENT DOCUMENTS

| | | | |
|---|---|---|---|
| 1,678,241 | 7/1928 | Benz | 24/73 GC |
| 3,205,544 | 9/1965 | Streule et al. | 24/73 GC |
| 3,618,235 | 11/1971 | Cary, Jr. | 36/50 X |
| 3,626,610 | 12/1971 | Dassler | 36/50 |
| 3,827,107 | 8/1974 | Moore | 24/204 X |
| 3,943,981 | 3/1976 | De Brabander | 24/204 X |
| 4,079,527 | 3/1978 | Antonious | 36/51 |
| 4,081,916 | 4/1978 | Salisbury | 36/50 |
| 4,114,297 | 9/1978 | Famolare, Jr. | 36/50 |
| 4,126,951 | 11/1978 | Antonious | 36/54 |

FOREIGN PATENT DOCUMENTS

| | | | |
|---|---|---|---|
| 935640 | 10/1973 | Canada | 36/50 |
| 2319887 | 11/1973 | Fed. Rep. of Germany | 24/204 |
| 1471601 | 1/1967 | France | 36/51 |
| 2271782 | 12/1975 | France | 24/204 |

OTHER PUBLICATIONS

P.R.N. #1148, 12/4/72, Bauer.

*Primary Examiner*—James Kee Chi

*Attorney, Agent, or Firm*—Nicholas J. Aquilino

[57] ABSTRACT

A shoe having an opening with an adjustable instep gore assembly including a strap having a hook and loop Velcro type closure which permits the wearer to pull both sides of the shoe, simultaneously, to the desired tautness before fastening.

17 Claims, 12 Drawing Figures

FIG. 1A.
FIG. 1.
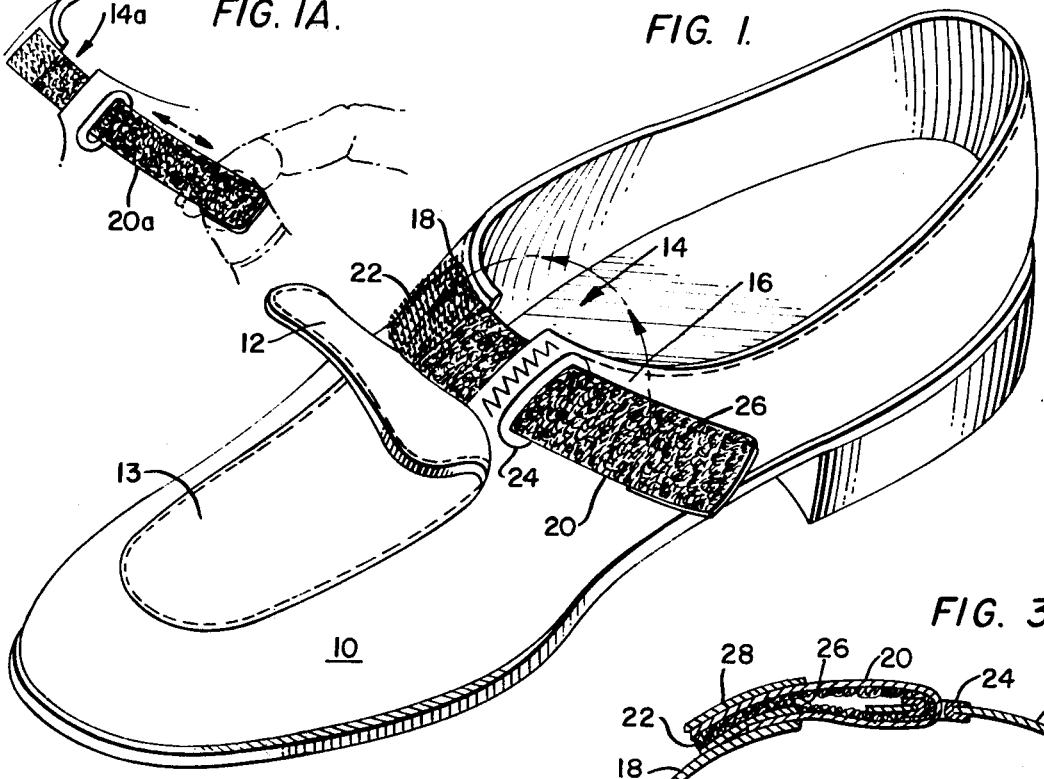
FIG. 3.
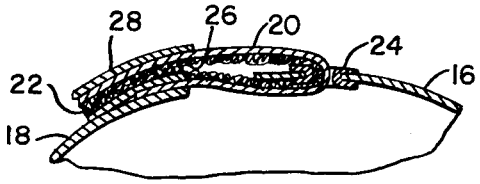
FIG. 2.
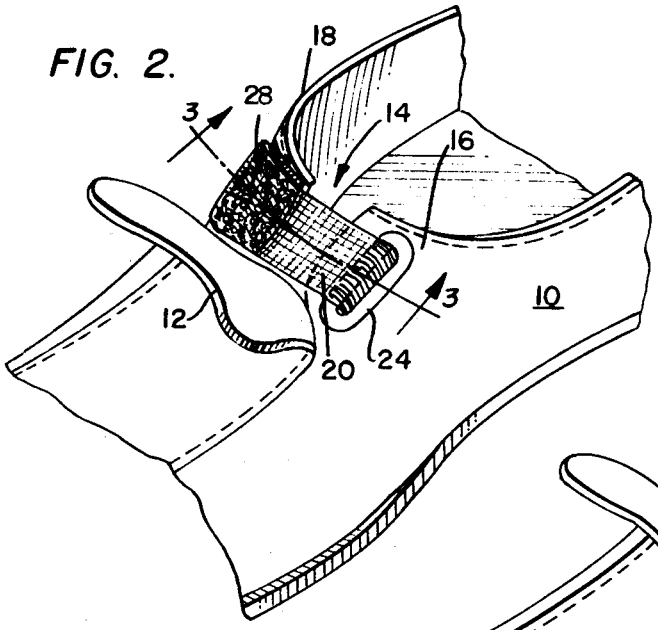
FIG. 4.
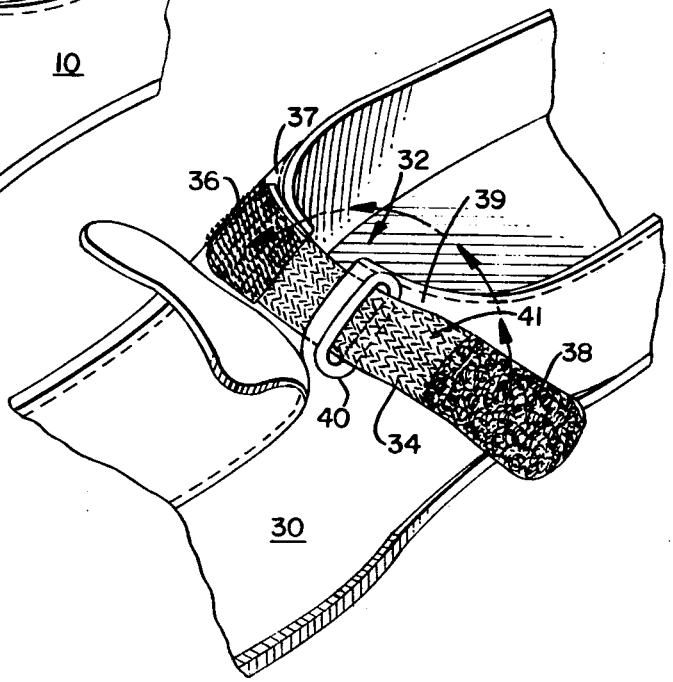

ADJUSTABLE INSTEP GORE ASSEMBLY

BACKGROUND OF THE INVENTION

The present invention relates to shoes and, more particularly, to a shoe having an adjustable instep gore assembly for regulating the tautness of the upper portion of the shoe.

Many types of shoes presently made include a gore connecting the quarters of the shoe. The gore is generally a piece of elastic that spans the shoe opening and is attached to the edge of the quarter section located on each side of the shoe. Whereas, the elastic provides a certain measure of flexibility, a number of people with high or low instep configurations have difficulty in getting the shoes to fit properly and be comfortable when wearing these types of shoes. People with high insteps must either have the gore replaced with longer elastic or sever the gore completely to have the shoe fit comfortably, which then creates the problem of having minimal support from the quarters of the shoe. Others with small insteps must either have the gore shortened or replaced or attach pads or the like under the upper flap or upper vamp to have the shoe fit properly.

SUMMARY OF THE INVENTION

The present invention relates to an adjustable instep gore assembly designed to eliminate the problems created by improper fitting when the conventional gore provided is not of the proper length.

The adjustable instep gore assembly includes a strap, one end of which is fixed to one side of the shoe and the other end of which is free and adapted to connect to the other side of the shoe. A Velcro type hook and loop fastener is provided on the strap assembly and/or shoe to secure the strap after pulling the two sides of the shoe to the desired tautness.

Among the objects of the present invention is to make available a shoe having an instep gore with multi-position adjustability to accommodate the various instep sizes of the feet of all wearers, so that all shoes can be made to fit and feel as comfortable as custom fitted shoes.

BRIEF DESCRIPTION OF THE DRAWINGS

FIG. 1 is a perspective view of the present invention showing the assembly in its open position.

FIG. 1*a* is a partial view of the shoe of FIG. 1 showing a modification thereof.

FIG. 2 is a partial view of the shoe of FIG. 1 showing the assembly in the closed position.

FIG. 3 is a sectional view taken along lines 3—3 of FIG. 2.

FIG. 4 is a partial view of a shoe showing another embodiment of the present invention.

DESCRIPTION OF THE PREFERRED EMBODIMENTS

Figure 5:
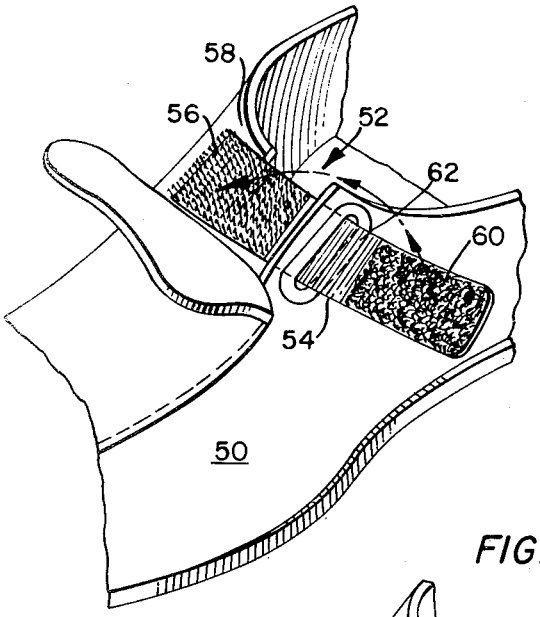
FIG. 5 is a partial view of a shoe showing a further embodiment of the present invention.

FIGS. 1, 2 and 3 illustrate one embodiment of the present invention. A low cut slip-on type shoe 10 is shown with the upper flap 12 of the vamp 13 folded back. FIG. 1 shows an adjustable instep gore assembly 14 in its open position whereas FIGS. 2 and 3 illustrate the adjustable instep gore assembly in the fastened position.

The adjustable instep gore assembly 14 of the present invention is connected between quarter 16 on one side of the shoe 10 and quarter 18 on the opposite side of the shoe 10. The adjustable instep gore assembly includes a gore strap 20, one end of which is fixed, by sewing or other suitable fastening means, to the quarter 18. The other end of the gore strap 20 is free. The fixed end of the gore strap 20 includes a pad 22 of Velcro type fastening material. The pad 22 is shown as hook type Velcro, although it will be appreciated that all the hook and loop Velcro type fasteners used in the present invention may be interchangeable. Preferably, the pad 22 is positioned on the outer quarter 18. The inner quarter 16 is formed with an opening which preferably is made with a grommet 24. The free end of the gore strap 20 is made with a loop Velcro type fastener pad 26 covering the entire length of one surface of the gore strap from the edge of the quarter 18 to the end of the gore strap 20. The Velcro pads 22 and 26 are adjacent to each other to permit variable adjustments as described below. The free end of the gore strap 20 may include a covering 28 on the back or top side of the gore strap 20 as shown in FIGS. 2 and 3 to provide stability at the point where the gore strap 20 is gripped when it is fastened or opened. After the shoe 10 is placed on the foot of the wearer, the free end of the gore strap 20 is passed through the opening 24 and folded back upon itself. The Velcro type pads 22 and 26 are pressed together at a point where the length of the gore strap 20 is comfortable to fasten the instep gore assembly 14 and the upper flap 12 is returned to its normal position. Because the Velcro type pad 26 extends the entire length of the gore strap 20 from the edge of the quarter to the end of the strap, it can be fastened to the coacting Velcro type pad 22 at any position, thereby giving the gore strap 20 the variable linear multi-position adjustability as required by the instep size of the foot of the wearer of the shoe.

FIG. 1*a* shows a modification of the adjustable gore assembly 14*a* shown in FIG. 1 wherein the gore strap 20*a* is made of elasticized material increasing the stretchability of the assembly. Elasticized Velcro may be substituted for the plain Velcro in all the other embodiments of the present invention; FIG. 1*a l* is merely representative of this arrangement.

FIG. 4 shows another embodiment of the present invention. A shoe 30 is formed with an adjustable instep gore assembly 32 having a gore strap 34 including a hook Velcro type pad 36 located on the quarter 37 opposite the quarter 39 having a grommet 40 and a loop Velcro type pad 38 at its free end. The gore strap 34 is formed with an elastic section 41 between the Velcro pad 36 and Velcro pad 38. This permits more flexing for additional comfort while maintaining the desired degree of tautness in the instep gore assembly 32 after it is fastened in the same manner as described with respect to FIGS. 1–3.

FIG. 5 illustrates still another embodiment of the present invention. A shoe 50 is formed with an adjustable instep gore assembly 52. A gore strap 54 includes a hook Velcro type pad 56 having a portion located directly on the quarter 58 and a portion extending onto the gore strap 54 itself. The free end of the gore strap 54 is made with a loop Velcro type pad 60. The section 62 of the gore strap 54 between the Velcro pad 56 and pad 60 is made of suitable strap material such as vinyl, nylon, cloth, and leather or the like, and has no elastic. This instep gore assembly 52 is fastened the same way as the embodiments described above. The length of the Velcro pad 56 extending onto the gore strap 54 permits greater flexibility of adjustment of the instep gore assembly 52.

Figure 5A:
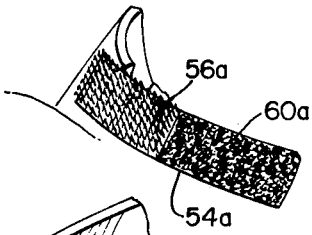
FIG. 5*a* is a partial view of the shoe of FIG. 5 showing a modification thereof.

FIG. 5*a* shows a modification of the strap 54 of FIG. 5. The strap 54*a* includes a hook Velcro pad 56*a* and a loop Velcro pad 60*a* which adjoin so that the entire surface of the strap 54*a* is covered with the Velcro material. No strap material is located between the Velcro pads and this increases the adjustability of the assembly.

Figure 6:
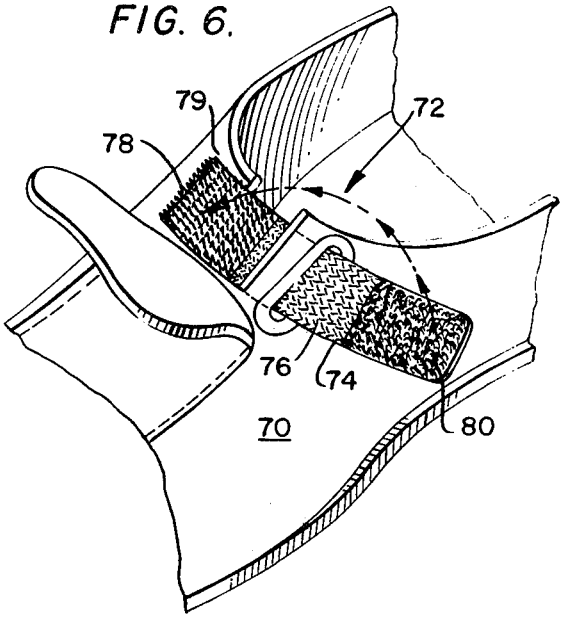
FIG. 6 is a partial view of a shoe showing yet another embodiment of the present invention.

FIG. 6 illustrates a further embodiment of the invention. A shoe 70 has an adjustable instep gore assembly 72 formed in the same way as the embodiment of FIG. 5 including a gore strap 74, except for the addition of an elastic section 76 formed between the hook Velcro pad 78, located on quarter 79 and which extends onto the strap 74 and the loop Velcro pad 80 at the free end of the strap 74. The elastic section 76 permits the gore strap 74 to stretch as the foot flexes.

Figure 7A:
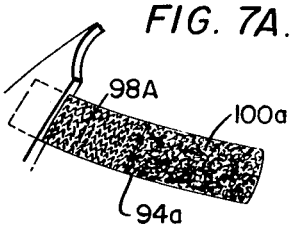
FIG. 7*a* is a partial view of the shoe of FIG. 7 showing a modification thereof.
Figure 7:
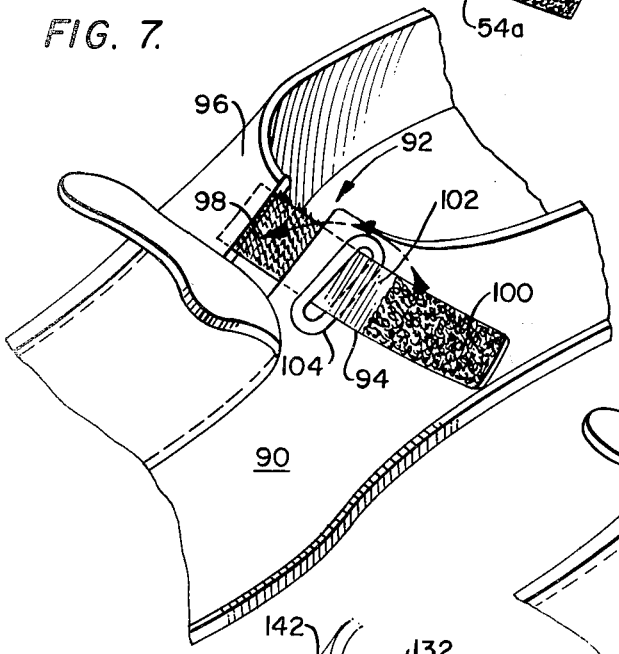
FIG. 7 shows still another embodiment of the present invention.

FIG. 7 illustrates another further embodiment of the present invention. A shoe 90 is made with an adjustable instep gore assembly 92 including a gore strap 94, the fixed end of which is secured to the quarter 96 of the shoe 90, and extends only from the edge of the quarter 96, rather than as shown in other previously described embodiments of the invention. The fixed end of the gore strap 94 may be sewn or otherwise secured between the quarter section panels or to the underside of the quarter 96. A loop type Velcro pad 100 is located on the free end of the gore strap 94 and the section 102 of the gore strap 94 between the Velcro pad 98 and Velcro pad 100 is made of suitable strap material. In this embodiment also, the gore strap 94 is fastened in the same manner through a grommet 104 and folded back on itself as described with respect to the previous embodiments.

FIG. 7*a* shows a modification of the strap 94 of FIG. 7. The strap 94*a* includes a hook Velcro pad 98*a* and a loop Velcro pad 100*a* in adjoining relationship similar to the strap of FIG. 5*a*.

Figure 8:
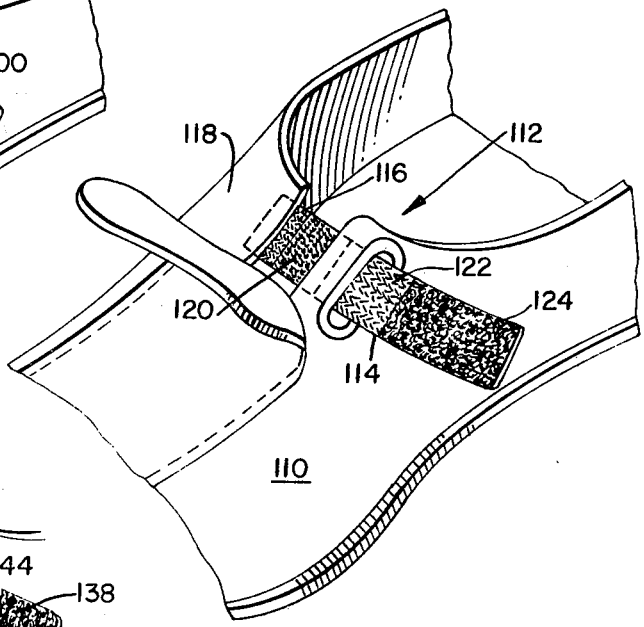
FIG. 8 shows a partial view of a shoe showing still another embodiment of the present invention.

FIG. 8 illustrates still another embodiment of the present invention. A shoe 110 is formed with an adjustable instep gore assembly 112 in the same manner as the embodiment of FIG. 7 except a gore strap 114 includes an elastic section 116 between the edge of the quarter 118 and a hook type Velcro pad 120. Also, the section 122 between the hook Velcro pad 120 and a loop Velcro pad 124 is elastic, which stretches as the foot flexes to provide greater comfort.

Figure 9:
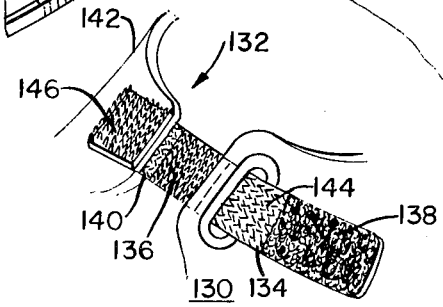
FIG. 9 is a partial view of a shoe showing still yet another embodiment of the present invention.

FIG. 9 illustrates yet another embodiment of the present invention. A shoe 130 includes an adjustable instep gore assembly 132 made the same way as the embodiment of FIG. 8 including a gore strap 134 having a hook Velcro type pad 136 and a loop Velcro pad 138. An elastic section 140 is provided between the edge of the quarter 142 and the hook Velcro pad 136. A second elastic section 144 is provided between the hook Velcro pad 136 and the loop Velcro pad 138. This assembly 132 further includes a second hook Velcro type pad 146 on the quarter 142 of the shoe 130 in addition to the hook Velcro type pad 136 on the gore strap 134. The loop Velcro pad 138 at the free end of the gore strap 134 may coact with hook Velcro pad 136 on the gore strap 134 or the hook Velcro pad 146 on the quarter 142 or coact with both hook Velcro pads 136 and 146 to fasten the instep gore assembly. This arrangement has at least a dual elastic means for additional flexing and at least a dual placement of Velcro pads to coact with the Velcro pad on the free end of the strap to permit greater variability of fastening positions for a greater degree of comfort.

Among the variations which may be used with the present invention is elasticized hook and loop Velcro material, plain hook and loop Velcro material or the hook and loop Velcro combined with elastic or any combination thereof. As mentioned hereinabove, the hook and loop pads of the Velcro fasteners may be interchangeable and made in various lengths and sizes suitable for a particular size shoe. Also the position of the entire instep gore assembly may be reversed by interchanging the positions of the grommet and the fixed end of the gore strap on the inner and outer quarter sections. Further, the size and position of the assembly with respect to the shoe may be varied without departing from the scope of the present invention.

What is claimed is:

1. In a shoe having an opening defined by quarters on either side of said opening in combination with an upper vamp, the improvement comprising:

an adjustable instep gore assembly connecting said quarters and underlying said upper vamp, said upper vamp extending beyond said gore assembly said gore assembly including flexible multi-position, co-acting hook and loop fastening means, a gore strap connected to one of said quarters, said strap having a fixed end and a free end, said free end including at least one fastener pad of said hook and loop fastening means, and an anchor means including an opening at the other of said quarters through which said free end of said strap passes permitting both of said quarters to be pulled inwardly to the precise desired tautness and said fastening means to be secured.

2. The shoe of claim 1 further including a second fastener pad of said hook and loop fastening means located adjacent said fixed end of said gore strap on said one of said quarters whereby said strap is folded back upon itself after passing through said opening to secure said fastener pads together.

3. The shoe of claim 1 wherein said opening is a grommet.

4. The shoe of claim 1 wherein at least one of said coating fastener pads is located on said fixed end of said strap.

5. The shoe of claim 1 wherein at least one of said fastener pads is located on one of said quarters and extends onto said strap.

6. The shoe of claim 4 further including another fastener pad located on one of said quarters and elastic means between said fastener pad quarters and the said fastener pad on said fixed end of said strap.

7. The shoe of claim 4 further including elastic means between said fastener pad located at said fixed end of said strap and said fastener pad located on said free end of said strap.

8. The shoe of claim 1 further including elastic means between said fastener pad at the free end of said strap and coacting fastener pad located on one of said quarters.

9. The shoe of claim 5 further including elastic means between said fastener pad located on one of said quarters and extending onto said strap and coacting fastener pad at the free end of said strap.

10. The shoe of claim 7 further including elastic means connecting one of said quarters and said pad at said fixed end of said strap.

11. The shoe of claim 4 further including elastic means connecting said fastener pad located on said fixed end of said strap and one of said quarters.

12. The shoe of claim 1 wherein said fastening means is made of elasticized hook and loop material.

13. The shoe of claim 12 further including elastic means in combination with elasticized hook and loop material in said strap.

14. The shoe of claim 1 wherein said strap is made entirely of hook or loop Velcro type material including two fastener pads, one of said pads being located at said free end and coacting with the other of said fastener pads at said fixed end.

15. The shoe of claim 1 wherein said strap is made entirely of elasticized hook and loop material.

16. The shoe of claim 14 wherein said strap is made entirely of elasticized hook and loop material. pg,16

17. The shoe of claim 1 wherein said upper vamp is positioned to extend beyond the upper edge of said gore strap.

* * * * *